United States Patent [19]

Huang et al.

[11] Patent Number: 4,842,819

[45] Date of Patent: Jun. 27, 1989

[54] CHROMIUM-MODIFIED TITANIUM ALUMINUM ALLOYS AND METHOD OF PREPARATION

[75] Inventors: Shyh-Chin Huang, Latham; Michael F. X. Gigliotti, Jr., Scotia, both of N.Y.

[73] Assignee: General Electric Company, Schenectady, N.Y.

[21] Appl. No.: 138,481

[22] Filed: Dec. 28, 1987

[51] Int. Cl.[4] ..... C22C 14/00; C21D 1/00

[52] U.S. Cl. ..... 420/418; 148/421; 420/407; 420/421

[58] Field of Search ..... 420/418, 407, 421; 148/126

[56] References Cited

U.S. PATENT DOCUMENTS

| | | | |
|---|---|---|---|
| 3,203,794 | 8/1965 | Jaffee et al. | 420/418 |
| 4,294,615 | 10/1981 | Blackburn et al. | 420/420 |
| 4,661,316 | 4/1980 | Hashimoto et al. | 420/418 |

FOREIGN PATENT DOCUMENTS

| | | | |
|---|---|---|---|
| 0220571 | 7/1957 | Australia | 420/418 |

OTHER PUBLICATIONS

"Research, Development, and Prospects of TiAl Intermetallic Compound Alloys", by Tokuzo Tsujimoto, Titanium and Zirconium, vol. 33, No. 3, 159 Jul., 1985, pp. 1–19.

"Titanium Aluminides—An Overview", by Harry A. Lipsitt, Mat. Res. Soc. Symposium, Proc. vol. 39, 1985, Materials Research Society, pp. 351–364.

"Effect of Rapid Solidification in $Ll_0$TiAl Compound Alloys", by S. H. Whang et al., ASM Symposium Proceedings on Enhanced Properties in Struc. Metals Via Rapid Solidification, Materials Week, 1986, Oct., 1986, pp. 1–7.

Izvestiya Akademii Nauk SSSR, Metally, No. 3, pp. 164–168, 1984.

"The Effects of Alloying on the Microstructure and Properties of $Ti_3Al$ and TiAl", P. L. Martin, H. A. Lipsitt, N. T. Nuhfer & J. C. Williams, Titanium 80, (Published by the American Society of Metals, Warrendale, PA), vol. 2, pp. 1245–1254, 1980.

*Primary Examiner*—Upendra Roy

*Attorney, Agent, or Firm*—Paul E. Rochford; James C. Davis, Jr.; James Magee, Jr.

[57] ABSTRACT

A TiAl composition is prepared to have high strength and to have improved ductility by altering the atomic ratio of the titanium and aluminum to have what has been found to be a highly desirable effective aluminum concentration by addition of chromium according to the approximate formula $Ti_{52-50}Al_{46-48}Cr_2$.

12 Claims, 3 Drawing Sheets

CHROMIUM-MODIFIED TITANIUM ALUMINUM ALLOYS AND METHOD OF PREPARATION

CROSS REFERENCE TO RELATED APPLICATIONS

The subject application relates to copending applications as follows:

Ser. No. 138,476 (RD-17,609) filed 12-28-87;
Ser. No. 138,486 (RD-17,790) filed 12-28-87;
Ser. No. 138,485 (RD-17,791) filed 12-28-87;
Ser. No. 138,407 (RD-17,813) filed 12-28-87; and
Ser. No. 138,408 (RD-18,454) filed 12-28-87.

The texts of these related applications are incorporated herein by reference.

The present invention relates generally to alloys of titanium and aluminum. More particularly it relates to alloys of titanium and aluminum which have been modified both with respect to stoichiometric ratio and with respect to chromium addition.

It is known that as aluminum is added to titanium metal in greater and greater proportions the crystal form of the resultant titanium aluminum composition changes. Small percentages of aluminum go into solid solution in titanium and the crystal form remains that of alpha titanium. At higher concentrations of aluminum (including about 25 to 35 atomic %) an intermetallic compound $Ti_3Al$ is formed. The $Ti_3Al$ has an ordered hexagonal crystal form called alpha-2. At still higher concentrations of aluminum (including the range of 50 to 60 atomic % aluminum) another intemetallic compound, TiAl, is formed having an ordered tetragonal crystal form called gamma.

The alloy of titanium and aluminum having a gamma crystal form and a stoichiometric ratio of approximately one is an intermetallic compound having a high modulus, a low density, a high thermal conductivity, good oxidation resistance, and good creep resistance. The relationship between the modulus and temperature for TiAl compounds to other alloys of titanium and in relation to nickel base super-alloys is shown in FIG. 1. As is evident from the figure the TiAl has the best modulus of any of the titanium alloys. Not only is the TiAl modulus higher at temperature but the rate of decrease of the modulus with temperature increase is lower for TiAl than for the other titanium alloys. Moreover, the TiAl retains a useful modulus at temperatures above those at which the other titanium alloys become useless. Alloys which are based on the TiAl intermetallic compound are attractive lightweight materials for use where high modulus is required at high temperatures and where good environmental protection is also required.

One of the characteristics of TiAl which limits its actual application to such uses is a brittleness which is found to occur at room temperature. Also the strength of the intermetallic compound at room temperature needs improvement before the TiAl intermetallic compound can be exploited in structural component applications. Improvements of the TiAl intermetallic compound to enhance ductility and/or strength at room temperature are very highly desirable in order to permit use of the compositions at the higher temperatures for which they are suitable.

With potential benefits of use at light weight and at high temperatures, what is most desired in the TiAl compositions which are to be used is a combination of strength and ductility at room temperature. A minimum ductility of the order of one percent is acceptable for some applications of the metal composition but higher ductilities are much more desirable. A minimum strength for a composition to be useful is about 50 ksi or about 350 MPa. However, materials having this level of strength are of marginal utility and higher strengths are often preferred for some applications.

The stoichiometric ratio of TiAl compounds can vary over a range without altering the crystal structure. The aluminum content can vary from about 50 to about 60 atom percent. The properties of TiAl compositions are subject to very significant changes as a result of relatively small changes of one percent or more in the stoichiometric ratio of the titanium and aluminum ingredients. Also the properties are similarly affected by the addition of relatively similar small amounts of ternary elements.

PRIOR ART

There is extensive literature on the compositions of titanium aluminum including the $Ti_3Al$ intermetallic compound, the TiAl intermetallic compounds and the Ti $Al_3$ intermetallic compound. A U.S. Pat. No. 4,294,615, entitled 'Titanium Alloys of the TiAl Type' contains an extensive discussion of the titanium aluminide type alloys including the TiAl intermetallic compound. As is pointed out in the patent in column 1 starting at line 50 in discussing TiAl's advantages and disadvantages relative to $Ti_3Al$:

'It should be evident that the TiAl gamma alloy system has the potential for being lighter inasmuch as it contains more aluminum. Laboratory work in the 1950's indicated that titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys.'

It is known that the alloy system TiAl is substantially different from $Ti_3Al$ (as well as from solid solution alloys of Ti) although both TiAl and $Ti_3Al$ are basically ordered titanium aluminum intermetallic compounds. As the '615 patent points out at the bottom of column 1:

'Those well skilled recognize that there is a substantial difference between the two ordered phases. Alloying and transformational behavior of $Ti_3Al$ resemble those of titanium as the hexagonal crystal structures are very similar. However, the comound TiAl has a tetragonal arrangement of atoms and thus rather different alloying characteristics. Such a distinction is often not recognized in the earlier literature.'

The '615 patent does describe the alloying of TiAl with vanadium and carbon to achieve some property improvements in the resulting alloy.

A number of technical publications dealing with the titanium aluminum compounds as well as with the characteristics of these compounds are as follows:

1. E.S. Bumps, H.D. Kessler, and M. Hansen, 'Titanium-Aluminum System', *Journal of Metals*, June, 1952, pp. 609–614, Transactions Aime, Vol. 194.

2. H.R. Ogden, D.J. Maykuth, W.L. Finlay, and R.I. Jaffee, 'Mechanical Properties of High Purity Ti-Al Alloys', *Journal of Metals*, February, 1953, pp. 267–272, Transactions Aime, Vol. 197.

3. Joseph B. McAndrew, and H.D. Kessler, 'Ti-36 Pct Al as a Base for High Temperature Alloys', Journal of *Metals*, October, 1956, pp. 1348–1353, Transactions Aime, Vol. 206.

BRIEF DESCRIPTION OF THE INVENTION

One object of the present invention is to provide a method of forming a titanium aluminum intermetallic compound having improved ductility and related properties at room temperature.

Another object is to improve the properties of titanium aluminum intermetallic compounds at low and intermediate temperatures.

Another object is to provide an alloy of titanium and aluminum having improved properties and processability at low and intermediate temperatures.

Other objects will be in part, apparent and in part, pointed out in the description which follows.

In one of its broader aspects the objects of the present invention are achieved by providing a nonstoichiometric TiAl base alloy, and adding a relatively low concentration of chromium to the nonstoichiometric composition. The addition may be followed by rapidly solidifying the chromium-containing nonstoichiometric TiAl intermetallic compound. Addition of chromium in the order of approximately 1 to 3 parts in 100 is contemplated.

The rapidly solidified composition may be consolidated as by isostatic pressing and extrusion to form a solid composition of the present invention.

DETAILED DESCRIPTION OF THE INVENTION

Examples 1–3

Figure 1:
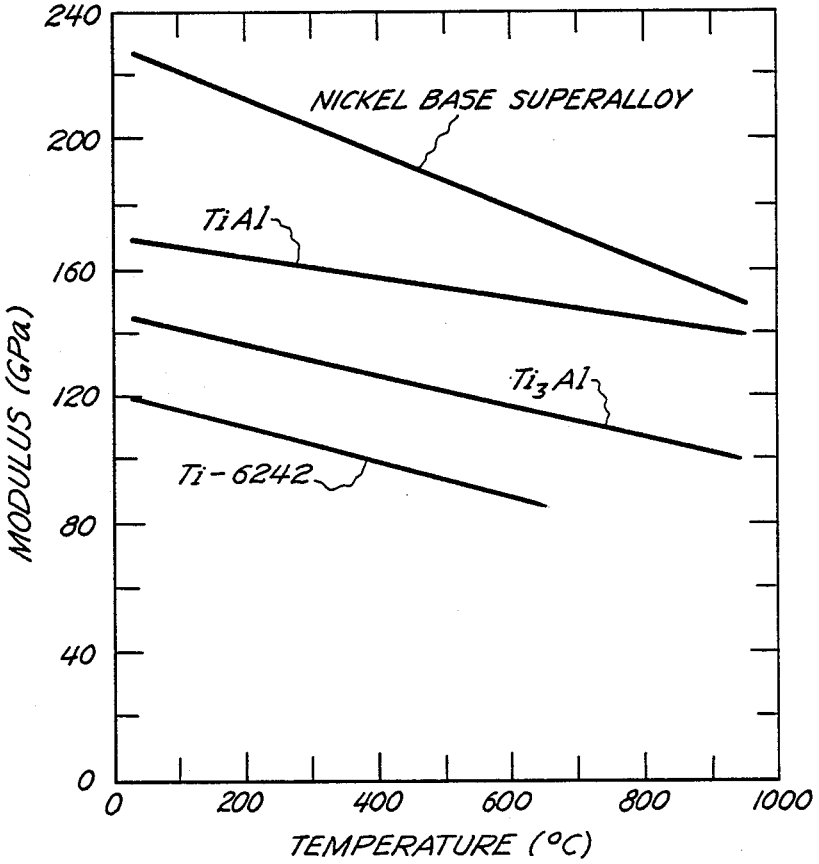
FIG. 1 is a graph illustrating the relationship between modulus and temperature for an assortment of alloys.

Three individual melts were prepared to contain titanium and aluminum in various stoichiometric ratios approximating that of TiAl. The compositions, annealing temperatures and test results of tests made on the compositions are set forth in Table I.

For each example the alloy was first made into an ingot by electro arc melting. The ingot was processed into ribbon by melt spinning in a partial pressure of argon. In both stages of the melting, a water-cooled copper hearth was used as the container for the melt in order to avoid undesirable melt-container reactions. Also care was used to avoid exposure of the hot metal to oxygen because of the strong affinity of titanium for oxygen.

The rapidly solidified ribbon was packed into a steel can which was evacuated and then sealed. The can was then hot isostatically pressed (HIPped) at 950° C. (1740° F.) for 3 hours under a pressure of 30 ksi. The HIPping can was machined off the consolidated ribbon plug. The HIPped sample was a plug about one inch in diameter and three inches long.

The plug was placed axially into a center opening of a billet and sealed therein. The billet was heated to 975° C. (1787° F.) and is extruded through a die to give a reduction ratio of about 7 to 1. The extruded plug was removed from the billet and was heat treated.

The extruded samples were then annealed at temperatures as indicated in Table I for two hours. The annealing was followed by aging at 1000° C. for two hours. Specimens were machined to the dimension of 1.5×3×25.4 mm (0.060×0.120×1.0 in) for four point bending tests at room temperature. The bending tests were carried out in a 4-point bending fixture having an inner span of 10 mm (0.4 in) and an outer span of 20 mm (0.8 in). The load-crosshead displacement curves were recorded. Based on the curves developed the following properties are defined:

1. Yield strength is the flow stress at a cross head displacement of one thousandth of an inch. This amount of cross head displacement is taken as the first evidence of plastic deformation and the transition from elastic deformation to plastic deformation. The measurement of yield and/or fracture strength by conventional compression or tension methods tends to give results which are lower than the results obtained by four point bending as carried out in making the measurements reported herein. The higher levels of the results from four point bending measurements should be kept in mind when comparing these values to values obtained by the conventional compression or tension methods. However, the comparison of measurements results in the examples herein is between four point bending tests for all samples measured and such comparisons are quite valid in establishing the differences in strength properties resulting from differences in composition or in processing of the compositions.

2. Fracture strength is the stress to fracture.

3. Outer fiber strain is the quantity of 9.71 hd, where h is the specimen thickness in inches and d is the cross head displacement of fracture in inches. Metallurgically, the value calculated represents the amount of plastic deformation experienced at the outer surface of the bending specimen at the time of fracture.

Figure 2:
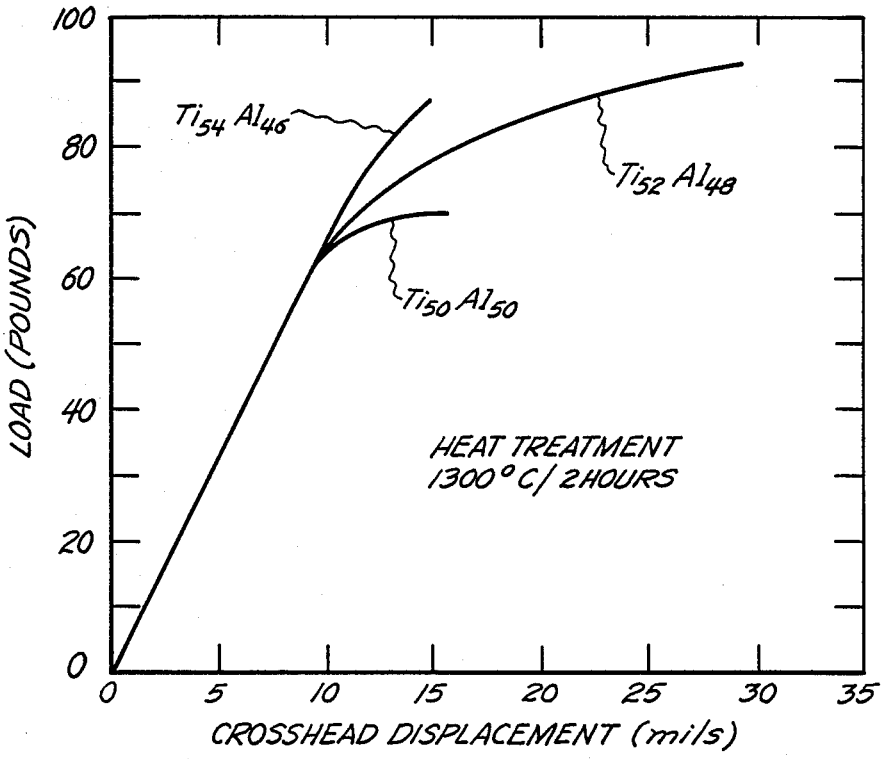
FIG. 2 is a graph illustrating the relationship between load in pounds and crosshead displacement in mils for TiAl compositions of different stoichiometry tested in 4-point bending.
Figure 3:
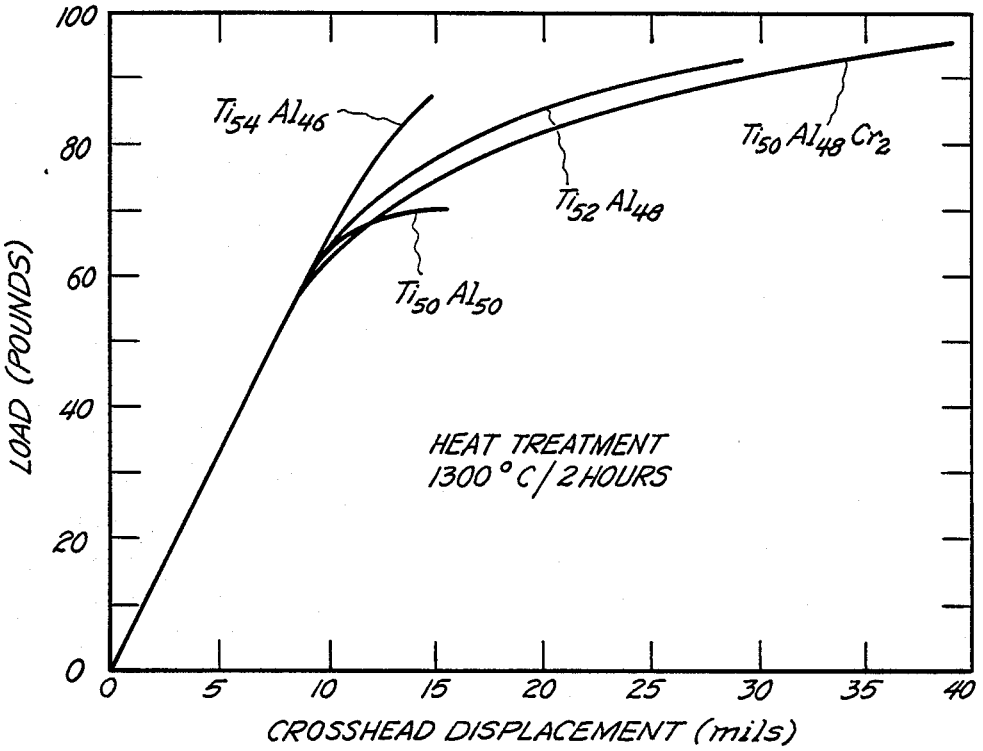
FIG. 3 is a graph similar to that of FIG. 2 but illustrating the relationship of FIG. 2 for $Ti_{50}Al_{48}Cr_2$.

The results are listed in the following Table I. Table I contains data on the properties of samples annealed at 1300° C. and further data on these samples in particular is given in FIG. 2.

TABLE I

| Ex. No. | Gamma Alloy No. | Composit. (wt. %) | Anneal Temp (°C.) | Yield Strength (ksi) | Fracture Strength (ksi) | Outer Fiber Strain (%) |
|---|---|---|---|---|---|---|
| 1 | 83 | $Ti_{54}Al_{46}$ | 1250 | 131 | 132 | 0.1 |
| | | | 1300 | 111 | 120 | 0.1 |
| | | | 1350 | —* | 58 | 0 |
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| | | | 1400 | 70 | 85 | 0.2 |
| 3 | 85 | $Ti_{50}Al_{50}$ | 1250 | 83 | 92 | 0.3 |
| | | | 1300 | 93 | 97 | 0.3 |
| | | | 1350 | 78 | 88 | 0.4 |

*No measurable value was found because the sample lacked sufficient ductility to obtain a measurement.

It is evident from the data of this table that alloy 12 for Example 2 exhibited the best combination of properties. This confirms that the properties of Ti-Al compositions are very sensitive to the Ti/Al atomic ratios and to the heat treatment applied. Alloy 12 was selected as the base alloy for further property improvements based on further experiments which were performed as described below.

It is also evident that the anneal at temperatures between 1250° C. and 1350° C. results in the test specimens having desirable levels of yield strength, fracture strength and outer fiber strain. However, the anneal at 1400° C. results in a test specimen having a significantly lower yield strength (about 20% lower); lower fracture strength (about 30% lower) and lower ductility (about 78% lower) than a test specimen annealed at 1350° C. The sharp decline in properties is due to a dramatic change in microstructure due in turn to an extensive beta transformation at temperatures appreciably above 1350° C.

EXAMPLES 4–13

Ten additional individual melts were prepared to contain titanium and aluminum in designated atomic ratios as well as additives in relatively small atomic percents.

Each of the samples were prepared as described above with reference to Examples 1–3.

The compositions, annealing temperatures, and test results of tests made on the compositions are set forth in Table II in comparison to alloy 12 as the base alloy for this comparison.

TABLE II

| Ex. No. | Gamma Alloy No. | Composit. (at. %) | Anneal Temp. (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| 4 | 22 | $Ti_{50}Al_{47}Ni_3$ | 1200 | —* | 131 | 0 |
| 5 | 24 | $Ti_{52}Al_{46}Ag_2$ | 1200 | —* | 114 | 0 |
| | | | 1300 | 92 | 117 | 0.5 |
| 6 | 25 | $Ti_{50}Al_{48}Cu_2$ | 1250 | —* | 83 | 0 |
| | | | 1300 | 80 | 107 | 0.8 |
| | | | 1350 | 70 | 102 | 0.9 |
| 7 | 32 | $Ti_{54}Al_{45}Hf_1$ | 1250 | 130 | 136 | 0.1 |
| | | | 1300 | 72 | 77 | 0.1 |
| 8 | 41 | $Ti_{52}Al_{44}Pt_4$ | 1250 | 132 | 150 | 0.3 |
| 9 | 45 | $Ti_{51}Al_{47}C_2$ | 1300 | 136 | 149 | 0.1 |
| 10 | 57 | $Ti_{50}Al_{48}Fe_2$ | 1250 | —* | 89 | 0 |
| | | | 1300 | —* | 81 | 0 |
| | | | 1350 | 86 | 111 | 0.5 |
| 11 | 82 | $Ti_{50}Al_{48}Mo_2$ | 1250 | 128 | 140 | 0.2 |
| | | | 1300 | 110 | 136 | 0.5 |
| | | | 1350 | 80 | 95 | 0.1 |
| 12 | 39 | $Ti_{50}Al_{46}Mo_4$ | 1200 | —* | 143 | 0 |
| | | | 1250 | 135 | 154 | 0.3 |
| | | | 1300 | 131 | 149 | 0.2 |
| 13 | 20 | $Ti_{49.5}Al_{49.5}Er_1$ | + | + | + | + |

*See asterisk note to TABLE I.
+Material fractured during machining to prepare test specimens.

For Examples 4 and 5 heat treated at 1200° C., the yield strength was unmeasurable as the ductility was found to be essentially nil. For the specimen of Example 5 which was annealed at 1300° C., the ductility increased, but it was still undesirably low.

For Example 6 the same was true for the test specimen annealed at 1250° C. For the specimens of Example 6 which were annealed at 1300 and 1350° C. the ductility was significant but the yield strength was low.

None of the test specimens of the other Examples were found to have any significant level of ductility.

It is evident from the results listed in Table II that the sets of parameters involved in preparing compositions for testing are quite complex and interrelated. One parameter is the atomic ratio of the titanium relative to that of aluminum. From the data plotted in FIG. 2 it is evident that the stoichiometric ratio or non-stoichiometric ratio has a strong influence on the test properties which formed for different compositions.

Another set of parameters is the additive chosen to be included into the basic TiAl composition. A first parameter of this set concerns whether a particular additive acts as a substituent for titanium or for aluminum. A specific metal may act in either fashion and there is no simple rule by which it can be determined which role an additive will play. The significance of this parameter is evident if we consider addition of some atomic percentage of additive X.

If X acts as a titanium substituent then a composition $Ti_{48}Al_{48}X_4$ will give an effective aluminum concentration of 48 atomic percent and an effective titanium concentration of 52 atomic percent.

If by contrast the X additive acts as an aluminum substituent then the resultant composition will have an effective aluminum concentration of 52 percent and an effective titanium concentration of 48 atomic percent.

Accordingly the nature of the substitution which takes place is very important but is also highly unpredictable.

Another parameter of this set is the concentration of the additive.

Still another parameter evident from Table II is the annealing temperature. The annealing temperature which produces the best strength properties for one additive can be seen to be different for a different additive. This can be seen by comparing the results set forth in Example 6 with those set forth in Example 7.

In addition there may be a combined concentration and annealing effect for the additive so that optimum property enhancement, if any enhancement is found, can occur at a certain combination of additive concentration and annealing temperature so that higher and lower concentrations and/or annealing temperatures are less effective in providing a desired property improvement.

The content of Table II makes clear that the results obtainable from addition of a ternary element to a non-stoichiometric TiAl composition are highly unpredictable and that most test results are unsuccessful with respect to ductility or strength or to both.

EXAMPLES 14 through 19

Six additional samples were prepared as described above with reference to Examples 1–3 to contain chromium modified titanium aluminide having compositions respectively as listed in Table III.

Table III summarizes the bend test results on all of the alloys both standard and modified under the various heat treatment conditions deemed relevant.

TABLE III

FOUR-POINT BEND PROPERTIES OF Cr-MODIFIED TiAl ALLOYS

| Ex. | Gamma Alloy Number | Composition (at. %) | Annealing Temperature (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.0 |
| | | | 1300 | 98 | 128 | 0.9 |
| | | | 1350 | 88 | 122 | 0.9 |
| 14 | 38 | $Ti_{52}Al_{46}Cr_2$ | 1250 | 113 | 170 | 1.6 |
| | | | 1300 | 91 | 123 | 0.4 |
| | | | 1350 | 71 | 89 | 0.2 |
| 15 | 49 | $Ti_{50}Al_{46}Cr_4$ | 1250 | 104 | 107 | 0.1 |
| | | | 1300 | 90 | 116 | 0.3 |
| 16 | 80 | $Ti_{50}Al_{48}Cr_2$ | 1250 | 97 | 131 | 1.2 |
| | | | 1300 | 89 | 135 | 1.5 |
| | | | 1350 | 93 | 108 | 0.2 |
| 17 | 79 | $Ti_{48}Al_{48}Cr_4$ | 1250 | 122 | 142 | 0.3 |
| | | | 1300 | 111 | 135 | 0.4 |
| | | | 1350 | 61 | 74 | 0.2 |
| 18 | 87 | $Ti_{48}Al_{50}Cr_2$ | 1250 | 108 | 122 | 0.4 |
| | | | 1300 | 106 | 121 | 0.3 |
| | | | 1350 | 100 | 125 | 0.7 |
| 19 | 88 | $Ti_{46}Al_{50}Cr_4$ | 1250 | 128 | 139 | 0.2 |
| | | | 1300 | 122 | 133 | 0.2 |
| | | | 1350 | 113 | 131 | 0.3 |

As is evident from the Table, each of the alloys 49, 79 and 88 show inferior strength and also inferior outer fiber strain (ductility) compared with the base alloy. They all contain 4 atomic percent chromium.

By contrast, alloy 38 of Example 14 showed only slightly reduced strength but greatly improved ductility. Also it can be observed that teh measured outer fiber strain varied significantly with the heat treatment conditions. A remarkable increase in the outer fiber strain was achieved by annealing at 1250° C. Reduced strain was observed when annealing at higher temperatures. Similar improvements were observed for alloy 80 although the annealing temperature was 1300° C. for the highest ductility achieved.

For Example 18 alloy 87 employed the desirable level of 2 atomic percent of chromium but the concentration of aluminum is increased to 50 atomic percent. The higher aluminum concentration leads to a small reduction in the ductility from the ductility measured for the two percent chromium compositions with aluminum in the 46 to 48 atomic percent range. For alloy 87 the optimum heat treatment temperature was found to be about 1350° C.

From Examples 14, 16 and 18 it was observed that the optimum annealing temperature increased with increasing aluminum concentration.

From this data it is determined that alloy 38 which has been heat treated at 1250° C. has the best combination of room temperature properties. Note that the optimum annealing temperature for alloy 38 with 46 at.% aluminum was 1250° C. but the optimum for alloy 80 with 48 at. % aluminum was 1300° C.

These remarkable increases in the ductility of alloy 38 on treatment at 1250° C. and of alloy 80 on heat treatment at 1300° C. were unexpected.

What is claimed is:

1. A chromium modified titanium aluminum alloy consisting essentially of titanium, aluminum and chromium in the following approximate atomic ratio:

$Ti_{54-48}Al_{45-49}Cr_{1-3}$.

2. A chromium modified titanium aluminum alloy consisting essentially of titanium, aluminum and chromium in the approximate atomic ratio of:

$Ti_{53-49}Al_{46-48}Cr_{1-3}$.

3. A chromium modified titanium aluminum alloy consisting essentially of titanium, aluminum and chromium in the following approximate atomic ratio:

$Ti_{53-49}Al_{45-49}Cr_2$.

4. A chromium modified titanium aluminum alloy consisting essentially of titanium, aluminum and chromium in the approximate atomic ratio of:

$Ti_{52-50}Al_{46-48}Cr_2$.

5. The alloy of claim 1, said alloy having been rapidly solidified from a molten state melt and consolidated by heat and pressure.

6. The alloy of claim 1, said alloy having been rapidly solidifed from a molten state and then consolidated through heat and pressure and given a heat treatment between 1350° C. and 1350° C.

7. The alloy of claim 2, said alloy having been rapidly solidifed from a molten state and consolidated through heat and pressure.

8. The alloy of claim 2, said alloy having been rapidly solidified from a molten state and then consolidated through heat and pressure and given a heat treatment between 1250° C. and 1350° C.

9. The alloy of claim 3, said alloy having been rapidly solidified from a molten state and consolidated through heat and pressure.

10. The alloy of claim 3, said alloy having been rapidly solidified from a molten state and then consolidated through heat and pressure and given a heat treatment between 1250° C. and 1350° C.

11. The alloy of claim 3, said alloy having been rapidly solidifed from a molten state and then consolidated through heat and pressure and given a heat treatment between 1250° C. and 1350° C.

12. The alloy of claim 4, said alloy having been rapidly solidifed from a molten state and consolidated through heat and pressure.

* * * * *